United States Patent [19]

Boles

[11] 4,174,747

[45] Nov. 20, 1979

[54] GOLF CLUBS RESTRAINER MEANS FOR USE WITH GOLF BAG

[75] Inventor: Richard J. Boles, Louisville, Ky.

[73] Assignee: Crest Circle, Inc., Louisville, Ky.

[21] Appl. No.: 960,305

[22] Filed: Nov. 13, 1978

[51] Int. Cl.[2] ..... A63B 55/00

[52] U.S. Cl. ..... 150/1.5 R; 24/16 PB; 24/73 SA

[58] Field of Search ..... 150/52 G, 1.5 R, 1.5 B, 150/1.5 C; 24/16 R, 16 PB, 73 R, 73 CF, 73 SA, 73 PB, 81 R, 81 CC; 206/315 R

[56] References Cited

U.S. PATENT DOCUMENTS

| | | | |
|---|---|---|---|
| 1,599,170 | 9/1926 | Fatjo | 150/1.5 R |
| 1,849,610 | 3/1932 | Boyce | 150/1.5 R |
| 1,915,889 | 6/1933 | Johnsen | 150/1.5 R |
| 2,708,955 | 5/1955 | Wilkens | 150/1.5 R |
| 2,752,973 | 7/1956 | Stamp | 150/1.5 R |
| 3,601,863 | 8/1971 | Dorsey | 24/16 PB |
| 3,947,927 | 4/1976 | Rosenthal | 24/16 R X |

*Primary Examiner*—Donald F. Norton
*Attorney, Agent, or Firm*—Richard L. Caslin

[57] ABSTRACT

A flexible, elongated restrainer means is shown for the temporary installation in the top opening of a golf bag for the firm, padded protection through and around a set of golf clubs while they are being stored and transported in the bag. This restrainer means would be the most useful when the golf bag and clubs are being transported in the trunk of a car or by plane when they are being subjected to travel vibrations and shocks. Before the use of the present invention, the heads of golf clubs were subject to self-damage during transportation by striking against each other in repetitive fashion for long periods of time. Golf clubs are expensive precision instruments and they should be protected from damage.

11 Claims, 9 Drawing Figures

GOLF CLUBS RESTRAINER MEANS FOR USE WITH GOLF BAG

BACKGROUND OF THE INVENTION

1. Field of the Invention:

This invention relates to a removable, flexible, elongated restrainer means for the temporary installation in the top opening of a golf bag for the firm, padded protection through and around a set of golf clubs while they are being stored during transit.

2. Description of the Prior Art

Before the present invention, golfers protected the heads of their golf clubs during transit either on foot or by vehicle; mainly, by use of individual club head covers fitted over each club head, or by the use of a bag cover fitted over all of the club heads, or by use of an overall carrying case. However, none of these protective means immobilized the clubs from sliding, banging and rattling around in the bag and possibly causing damage to each other.

OBJECTS OF THE PRESENT INVENTION

The principal object of the present invention is to provide a temporary golf clubs restrainer for use in the top opening of a golf bag for the firm, padded protection through and around a set of golf clubs.

A further object of the present invention is to provide a padded golf clubs restrainer means of a class described which firmly immobilizes the clubs and substantially prevents them from sliding relative to each other and making nicks on the adjacent club heads and shafts.

A further object of the present invention is to provide a temporary golf clubs restrainer means of the class described which is provided with an anchoring means adjacent one end that is engageable with the golf bag, and a self-fastening means at the other end.

A further object of the present invention is to provide a golf clubs restrainer of the class described which secures the clubs as a group as well as individually. Moreover, the clubs are held to the bag as well as to each other.

A further object of the present invention is to render the restrainer means weather resistant, easy to install, easy to remove, and easy to store away within the golf bag.

A further object of the restraining means of the present invention is to employ strategically located Velcro-type fasteners for use in its active mode applied to a golf bag and to a set of clubs as well as when the restraining means is rolled or folded into a self-contained, storage mode.

SUMMARY OF THE INVENTION

The present invention provides a separate, temporary golf clubs restrainer means for use in the top opening of a golf bag for immobilizing and providing padded protection between and around a set of golf clubs. This restrainer means comprises a narrow, elongated strap of flexible, weather resistant material that has resilient padding means for much of the length thereof. An anchoring means is located adjacent one end for attaching the strap to an anchoring means of the golf bag, while a fastening means is located adjacent the opposite end of the strap for attaching this latter end to the main body of the strap.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENTS

Figure 1:
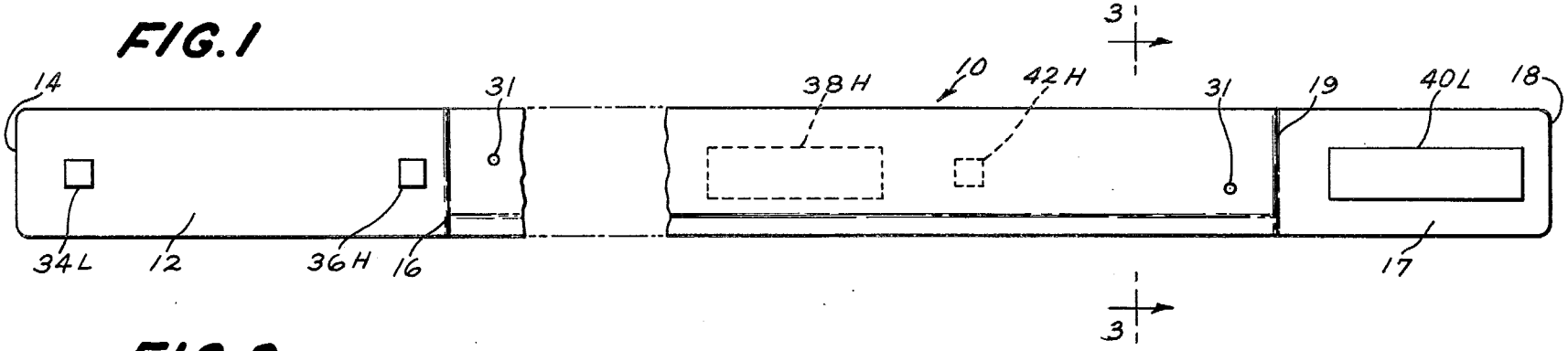
FIG. 1 is a front elevational view of the golf clubs restrainer strap of the present invention in its fully extended position showing a plurality of interlocking Velcro-type fastener pads spaced along the length thereof. This view is broken and a large central portion is not shown.

Turning now to a consideration of the drawings, and in particular to FIG. 1, there is shown a restrainer 10 in the form of a narrow, elongated strap or band of flexible, padded material which is quite long as compared with its width. For example, the strap 10 may be between 40" and 70" long, and perhaps 2" to 4" wide. The strap shown is approximately 60" long. The thickness of the strap may be of two sizes or more, or it may be of generally uniform width. If it is of two sizes, the thickness at the starter end 12 between the tip 14 and the line 16, and at the free end 17 between the tip 18 and the line 19, would be about half-size or between ¼" to ½", and the remainder of the intermediate length of the strap from line 16 to line 19 would be between about ¾" to 1" in thickness. Of course, other strap dimensions could be adopted without departing from the scope of the present invention.

Figure 3:
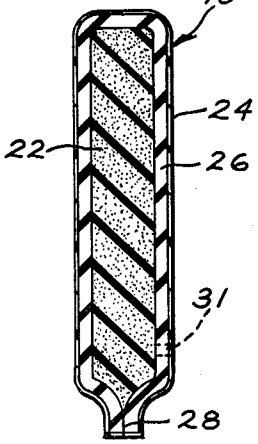
FIG. 3 is a transverse cross-sectional view on an enlarged scale of the restrainer strap taken on the line 3—3 of FIG. 1.

Many different designs and materials may be adopted in forming this flexible, padded strap 10. A main element of the strap 10 is a resilient core or pad 22 of foam rubber, or plastic, cotton batting or down, that is shown in FIG. 3, and which extends for nearly the complete length of the strap, between lines 16 and 19, although it may be of varying thickness, depending upon the thickness of the strap. This core 22 is for furnishing a resilient padding or cushion. Over the resilient core 22 would be fitted a flexible, weather resistant cover 24, which may be an exterior plastic cover material that is backed with a thin layer of foam rubber 26. This plastic cover 24 may be cut to size, and then folded over the resilient core 22 and then glued or stitched together along the free edges at 28.

Figure 8:
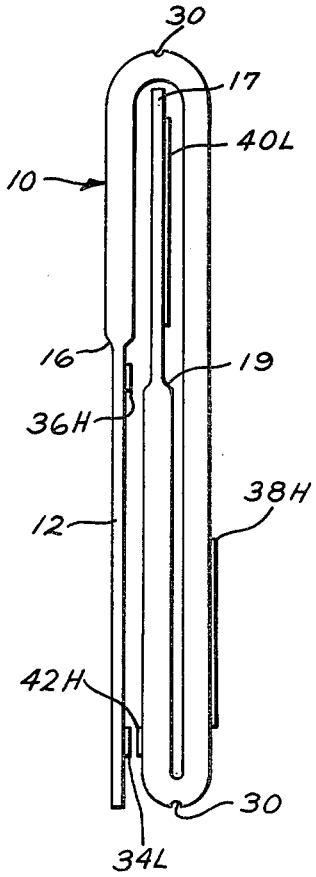
FIG. 8 is a full view of the restrainer strap of the present invention folded longitudinally into a storage condition for placement into one of the pockets of the golf bag.

The flexible cover 24 could be made of fabric if it were treated with a water-repellant substance. Another modification would be to form the flexible cover 24 of a thin leather material for improved appearance and wearability. The restrainer strap 10 may be folded longitudinally, as seen in FIG. 8, into a neat package for storage purposes. To facilitate this folding action, the foam rubber core 22 could have fold lines 30 of reduced thickness. A modification would be to roll up the restrainer strap 10 into a tight roll like a sleeping bag instead of using the folded pattern of FIG. 8. This rolled modification would be more feasible if the strap 10 were of a minimum thickness, such as less than ½", and perhaps less than ¼". The plastic cover 24 should not be inflatable, because problems will arise when folding the strap up for storage. Two breather holes 31 are formed in the cover 24 to release the air.

The strap 10 could be molded or extruded of plastic that will develop its own weather resistant skin, so it would be of one piece design, rather than of laminated design as shown.

Figure 2:
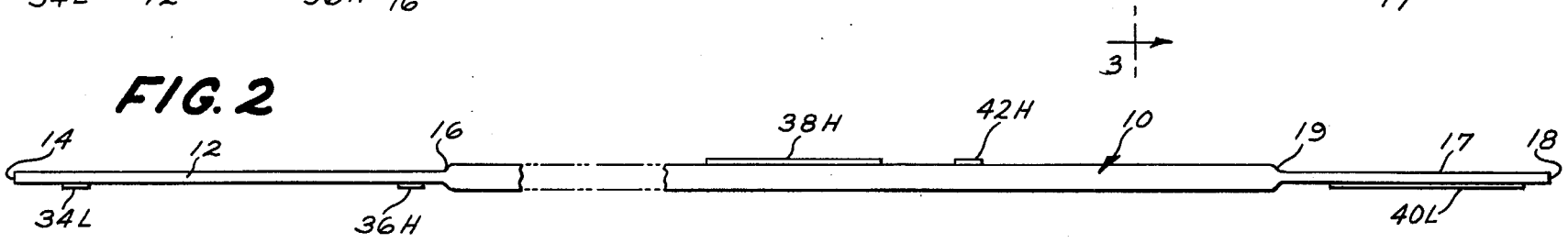
FIG. 2 is a top plan view of the restraining means of FIG. 1 showing the padded thickness of the main central portion of the restrainer strap, as well as the reduced thickness at the two ends of the strap.
Figure 5:
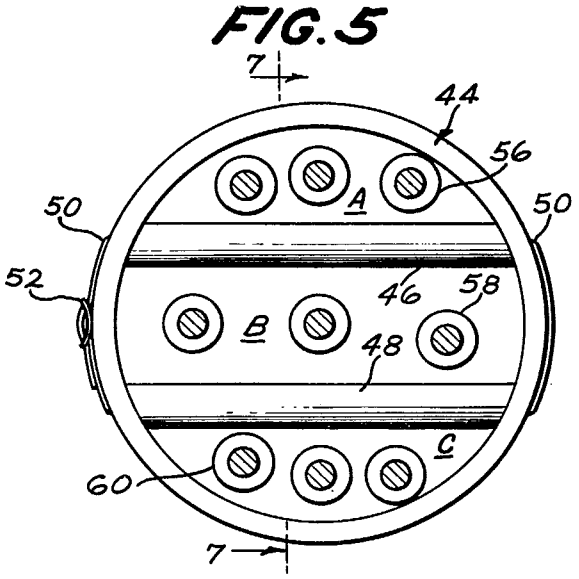
FIG. 5 is a top plan view similar to that of FIG. 4 showing the golf bag loaded with a set of golf clubs.

Turning back to a consideration of FIGS. 1 and 2, the strap 10 is shown with five fastener areas or pads, 34, 36, 38, 40 and 42. These fasteners are preferably of the interlocking kind which are sold under the trade name of VELCRO fasteners. They come in the form of mating pads. One of the interlocking fastener pads if formed like a woven cloth or carpet but having a plurality of geometric or random loops of miniature size. This pad of loops will be identified with the superscript L. The other interlocking fastener pad is formed with a plurality of geometric soft plastic hook members of miniature size. This pad of hooks will be identified with the superscript H.

When the loop pad L is pressed firmly against the hook pad H, many of the loops become interlocked with the hook members. This type of loop and hook fastener is particularly strong in resisting tension when pulling in the plane of the interlocking fastener pads. In order to release the fastener pads from each other, one pad is peeled off of the other one. When this takes place, the loops apply tension to the hooks so the plastic hooks will straighten out until the loops become disengaged from the hooks.

Figure 6:
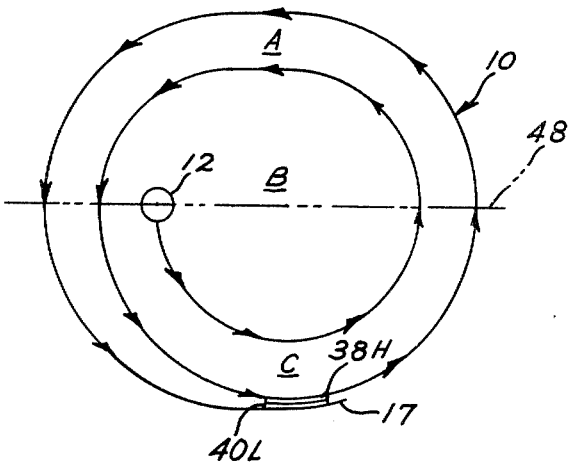
FIG. 6 is a schematic top plan diagram of the restrainer means in its spiral condition shown anchored to one or both of the bag cross-braces, and first wound firmly around the central group of clubs, then around the lower group and around the upper group. Finally, the loose end of the restrainer is attached to the main body of the restrainer.
Figure 9:
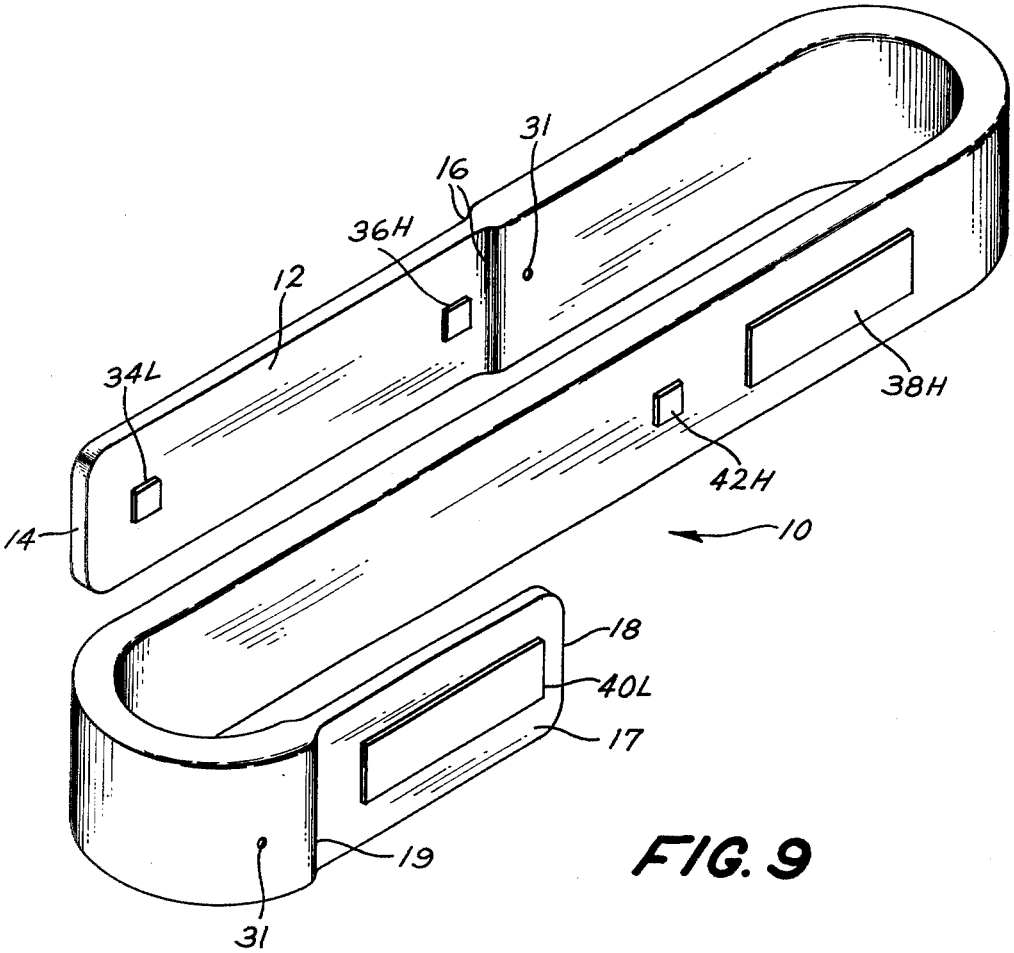
FIG. 9 is an isometric view of the restrainer strap showing its entire length to illustrate the relative locations of the fastener pads.

The fasteners 34 and 36 are interlocking to form an anchoring means to engage a cross brace 46 or 48 of the bag. The fasteners 38 and 40 are interlocking as is shown at the bottom of FIG. 6, and the fasteners 34 and 42 are interlocking when the restrainer strap is folded into a storage condition, as is shown in FIG. 8. For each pair 34, 36 and pair 38, 40 and pair 34, 42 there has to be one loop pad L and one hook pad H. As one example, pads 34 and 40 are designated as loop pads L, and pads 36, 38 and 42 are designated as hook pads H. Of course, they could be interchanged. As is shown in FIG. 9, the fastener 38 is located adjacent the central area of the restrainer strap.

Figure 4:
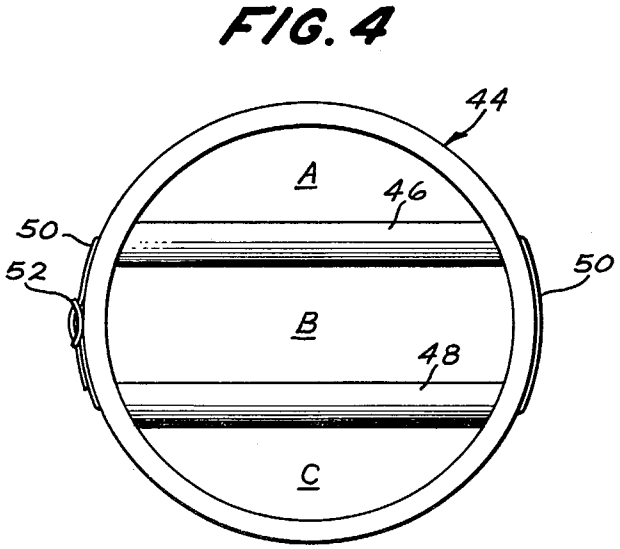
FIG. 4 is a top plan view of the top portion of a typical golf bag shown empty, without the golf clubs, to depict the general nature of the two parallel separators or cross-braces which divide the set of clubs into three groups.

FIG. 4 is a top plan view of the top portion of a typical golf bag 44 which is generally circular in cross section. Two parallel cross braces 46 and 48 are shown for dividing the mouth of the bag into three sections A, B and C. Typically, each cross brace 46 and 48 is a tubular member. A narrow, plastic or leather strap 50 is threaded through suitable slits (not shown) in the sides of the bag and through each cross brace. This narrow strap 50 has a buckle 52 so the two ends of this strap may be fastened together.

A typical set of golf clubs would include fourteen clubs. The woods 56 are shown stored in the first section A. The long irons 58 are shown in the central section B, and the short irons 60 are in the last section C. Of course, each individual golfer may vary this arrangement without departing from the scope of the present invention.

Figure 7:
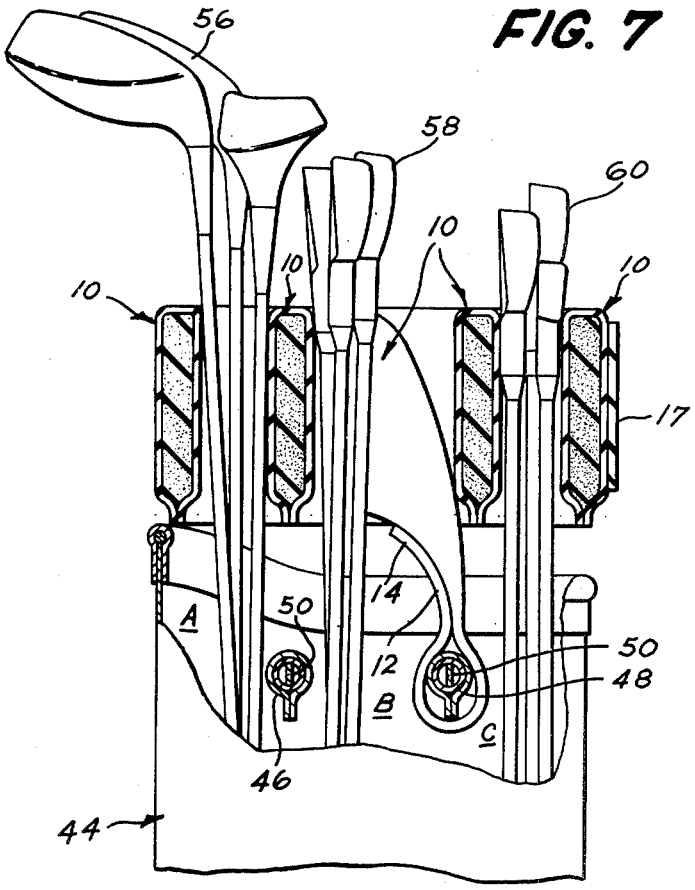
FIG. 7 is a cross-sectional elevational view taken on the line 7—7 of FIG. 5 of the top portion of the golf bag that is loaded with a set of golf clubs, and the clubs are confined in place by the restrainer of the present invention. The strap is shown raised and loosely wound so as to improve the understanding of how the strap is anchored to one of the cross-braces.

When the restrainer 10 is to be applied to a set of golf clubs in a golf bag, the restrainer strap 10 is first unfolded from the storage condition of FIG. 8, or unrolled from its rolled up condition. The following maneuver can best be understood with reference to FIGS. 4–7. The starter end 12 of the strap is looped around either one or both of the cross braces 46 and 48 and the fastener pads $34^L$ and $36^H$ are pressed together to form an anchoring means for the strap to the bag. Then the restrainer strap 10 is (1) drawn tight between the clubs 58 and 56 in sections B and A respectively, and then (2) drawn tight completely around only the clubs 58 in the central section B, and (3) continuing around the outside of clubs 60 in the C section to pull them tight against the wrapped central clubs 58, and (4) continuing around the outside of clubs 56 in the A section to pull them tight against the wrapped central clubs 58, and finally (5) pressing the fastener pad $40^L$ against the fastener pad $38^H$ so as to attach the free end 17 of the strap to the main body of the strap. The strap may either be wound clockwise or counterclockwise. To explain further as to FIG. 6, the clubs 58 in central section B are all pressed together in a cluster. Next the clubs 60 in section C are pressed against the section of the padded strap which encircles the clubs 58. Then on the other side of the bag, the clubs 56 in section A are also pressed against the section of the padded strap which encircles the clubs 58. Hence, there are in effect three clusters of clubs 58, 60 and 56 which are all huddled together in a single padded bundle, as is shown in FIG. 7. In this view the strap 10 is shown raised and wrapped loosely around the first group of clubs 58 to better illustrate how the strap is anchored to the cross brace 48. In actual practice, each group of clubs 58, 56 and 60 would be pressed on all sides by the strap 10, and the strap 10 would be tucked down into the bag.

It should be understood by those skilled in this art that while Velcro-type fasteners $34^L$, $36^H$, $38^H$, $40^L$ and $42_H$ are the preferred embodiment, other types of fasteners may be substituted. For example, mating snap fasteners (not shown) may be substituted for fasteners $34^L$ and $36^H$. Also, other fastener methods could be adopted to provide variable closure positions such as lacing, stepped hook and eye, pongee cord wrapped around knobs or hooked into holes, or button and button hooks.

The restrainer strap 10 of the present invention may be used in combination with the other means now in use to protect clubs such as club covers, bag covers and bag carrying cases.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A golf clubs restrainer means for use in the top opening of a golf bag for the padded protection of a set of golf clubs, said restrainer comprising:

(a) a narrow, elongated strap of flexible material having resilient padding means for much of the length thereof;

(b) and a plurality of complementary fastening means provided along the strap;

(c) a first anchoring means formed by certain of the said fastening means adjacent the starter end of the strap and adapted for attaching the strap to an anchoring means of a golf bag;

(d) a complementary set of said fastening means being adjacent both the finish end and the midsection of the strap for fastening this finish end to the main body of the strap.

2. A golf clubs restrainer as recited in claim 1 wherein the said elongated strap is formed of resilient padding having a weatherproof protective cover means, the said fastening means being attached to the cover means.

3. A golf clubs restrainer as recited in claim 2 wherein the said protective cover means is an integral skin of the said resilient padding.

4. A golf clubs restrainer as recited in claim 2 wherein the said protective cover means is a separate covering that is applied over the resilient padding.

5. A golf clubs restrainer as recited in claim 1 wherein the said resilient padding means is formed of synthetic plastic, and a separate protective cover of water resistant fabric material attached to the plastic padding, the said fastening means being attached to the fabric cover.

6. A golf clubs restrainer as recited in claim 1 wherein the said fastening means comprise Velcro fasteners, a first and second interlocking fastener pair being located at the starter end, and a third fastener being located adjacent the finish end and all on the front portion of the strap, while a fourth fastener located on the back portion of the strap adjacent the center thereof for engagement by the third fastener.

7. A golf clubs restrainer as recited in claim 6 wherein the said Velcro fasteners are oversized and of generally rectangular shape, the thickness of the strap being reduced at both the starter end and finish end of the strap.

8. A golf clubs restrainer as recited in claim 6 with the addition of a fifth fastener on the back portion of the strap for engagement with the first said fastener when the strap is folded into a compact shape for storage.

9. A method for restraining golf clubs within a golf bag, which comprises the steps of:

(a) attaching one end of a flexible, elongated padded strap to a fixed element adjacent the top opening of the bag;

(b) drawing the strap between a central group of clubs and a first outer group of clubs and encircling the strap firmly around the central group of clubs;

(c) continuing drawing the strap around the outside of the said first outer group of clubs to pull them tight against the wrapped central clubs;

(d) continuing drawing the strap around the outside of a second outer group of clubs to pull them tight against the wrapped central clubs; and (e) attaching the free end of the strap to the main body of the wrap-around strap.

10. The method of claim 9, in which Velcro-type fasteners are used for the last step of attaching the free end of the strap to the main body.

11. The method of claim 10, in which Velcro-type fasteners are used on the strap in the first step of attaching the end of the strap to the fixed element of the bag.

* * * * *